United States Patent [19]

Kenney et al.

[11] 3,936,201

[45] Feb. 3, 1976

[54] HANGER AND SHEET LIFTER FOR RING BINDER

[75] Inventors: William J. Kenney, Villa Park; Lester K. Fleischmann, Highland Park, both of Ill.

[73] Assignee: Standard Manifold Company, Chicago, Ill.

[22] Filed: July 18, 1974

[21] Appl. No.: 489,464

[52] U.S. Cl. ..... 402/4; 402/24; 402/80 L; 312/184

[51] Int. Cl.[2] ..... B42F 13/00

[58] Field of Search ..... 402/4, 24, 31, 75, 80 R, 402/80 L; 312/184; 281/15 A, 33

[56] References Cited

UNITED STATES PATENTS

| | | | |
|---|---|---|---|
| 1,438,061 | 12/1922 | Selianoff | 402/4 |
| 1,807,390 | 5/1931 | Crosby | 402/75 |
| 3,790,242 | 2/1974 | Sullivan | 402/4 X |

FOREIGN PATENTS OR APPLICATIONS

| | | | |
|---|---|---|---|
| 773,007 | 4/1957 | United Kingdom | 402/4 X |
| 1,025,546 | 1/1953 | France | 402/4 X |
| 680,215 | 8/1939 | Germany | 402/4 X |
| 35,470 | 7/1966 | Finland | 402/4 |

*Primary Examiner*—Jerome Schnall
*Attorney, Agent, or Firm*—Wegner, Stellman, McCord, Wiles & Wood

[57] ABSTRACT

A hanger and sheet lifter for ring binders or the like whereby the ring binder may be hung on spaced parallel rails conventionally employed in many filing systems. The hanger is defined by an elongated member having a length greater than the length of the spine of the ring binder with which it is to be used. The ends of the member are provided with hooks which open in the same direction. The member also includes a plurality of slots corresponding in number to the number of rings in the ring binder in which it is to be used and which extends longitudinally of the member. The length of the slot is such that the hanger can move from a position wherein both hooks extend outwardly from opposite ends of the spine of the ring binder to a position wherein one of the hooks is wholly received within the ring binder to enable the ring binder to be stood on end without the lowermost hook interfering with the supporting surface.

3 Claims, 5 Drawing Figures

HANGER AND SHEET LIFTER FOR RING BINDER

BACKGROUND OF THE INVENTION

This invention relates to ring binders and, more specifically, to a combination hanger and sheet lifter for a ring binder.

One popular form of filing system used today is that wherein two parallel rails support hanging files by means of hooks extending outwardly from opposite sides of the files to receive corresponding ones of the rails. One such system employs hanging folders marketed under the trademark PENDAFLEX.

As mentioned, such systems typically employ folders, the bottom of which supports the material to be filed. In some cases, ring binders for use in such systems have been proposed. Such binders, when stored, are suspended on parallel filing rails of the type mentioned previously. However, one difficulty presents itself when such binders are removed from the rails and, for example, stood on end while the contents are being inspected or, for that matter, stood on end in another location during temporary storage as between bookends. In such cases, the hooks conventionally found on the folders would interfere with the ability of the ring binder to stand upright by reason of its interfering contact with the subjacent supporting surface. This problem has been solved through the use of two individually retractable hanging hooks on opposite ends of the binder spine. However, both hooks must be manipulated separately and separate sheet lifters are required.

SUMMARY OF THE INVENTION

It is the principal object of the invention to provide a new and improved ring binder which may be hung during storage between spaced filing rails. More specifically, it is an object of the invention to provide a hanger which may be applied to existing ring binders to allow the same to be hung and yet which will not interfere with the ability of the ring binders to be stood on end. Still a further object of the invention, in general terms, is the provision of such a hanger for a ring binder wherein the elongated member serves as a sheet lifter as well as a member by which the binder may be hung.

The exemplary embodiment achieves the foregoing object in a construction including an elongated member having substantial width whereby the same may serve as a sheet lifter. The elongated member has a length greater than the length of the spine of the ring binder with which it is to be used and the ends terminate in hooks, both of which face in the same direction, for disposition on the parallel rails of a filing system.

The member includes a plurality of elongated slots which are elongated in the direction of elongation of the member. They are spaced and numbered according to the pattern of rings in the ring binder with which the combination hanger and sheet lifter is to be used and have a length sufficient so that the elongated member may be shifted from a position wherein both hooks extend outwardly from opposite ends of the spine of the ring binder to a position wherein one of the hooks is wholly within the ring binder so it will not interfere with the ability of the ring binder to support itself when stood on end.

According to a highly preferred embodiment of the invention, each of the slots is L-shaped and with reference to a ring binder stood on end, the L is inverted. The inverted base of the L is directed away from the spine of the ring binder and receives a corresponding ring of the ring binder when both hooks extend from opposite ends of the ring binder to orient the ring binder on the elongated member when the ring binder is to be suspended on parallel filing rails.

As mentioned, the hanger is intended to serve as a sheet lifter as well and to this end, two such members are typically employed with each ring binder. In a highly preferred embodiment, the elongated members are curved in a direction transverse to their elongated dimension.

Other objects and advantages will become apparent from the following specification taken in conjunction with the accompanying drawings.

DESCRIPTION OF THE PREFERRED EMBODIMENT

Figure 1:
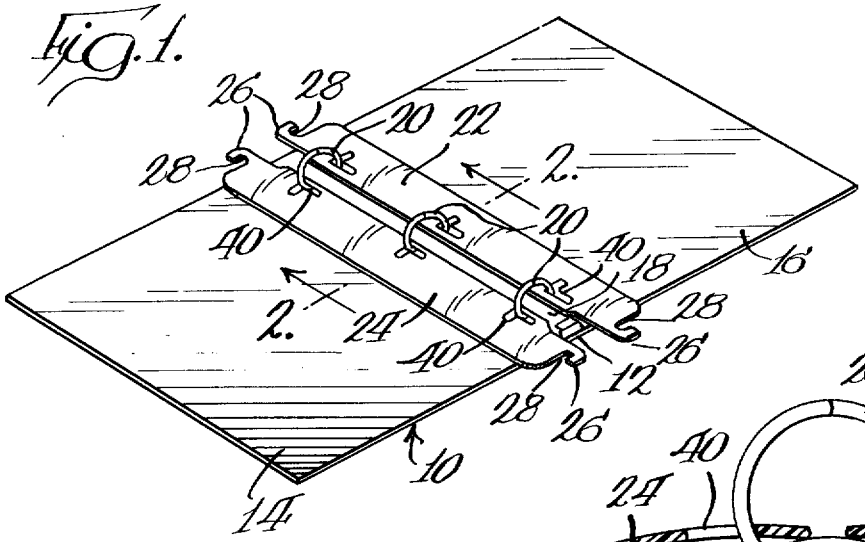
FIG. 1 is a perspective view of a ring binder embodying a combination hanger and sheet lifter made according to the invention.

An exemplary embodiment of the combination hanger and sheet lifter made according to the invention is illustrated in a ring binder generally designated 10 as illustrated in FIG. 1. The ring binder includes a central spine 12 flanked by a pair of cover members, the front cover member being designated 14 and the back cover member being designated 16.

Figure 2:
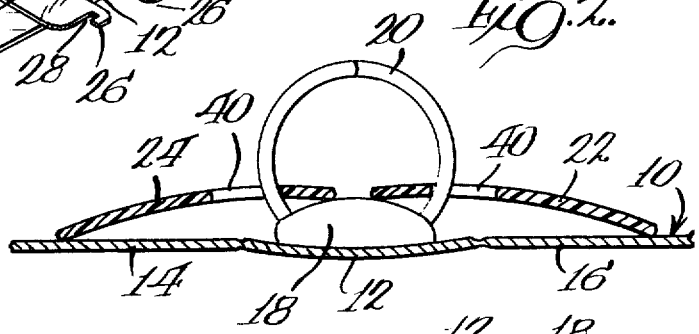
FIG. 2 is an enlarged, fragmentary, sectional view taken approximately along the lines 2—2 of FIG. 1.

As best seen in FIG. 2, an elongated housing 18 extends along the inner surface of the spine 12 and mounts a plurality of openable rings 20 in a conventional fashion. While FIG. 1 illustrates the employment of three of the rings 20, it will be appreciated by those skilled in the art that a greater or lesser number can be used depending upon the size of the ring binder 10 itself. Thus, the invention is not intended to be limited to any particular number of rings 20.

Disposed on the rings 20 is a first or rear hanger and sheet lifter 22 as well as a second, or front hanger and sheet lifter 24. As will be seen, the hanger and sheet lifters 22 and 24 are mirror images of each other and, thus, only the sheet lifter 22 will be described.

The sheet lifter 22 is formed of an elongated member composed of plastic composition material, or any other suitable material with a fair degree of stiffness. Opposite ends of the same terminate in hooks 26 and the length of the member is chosen such that the distance between extreme ends of the hooks is greater than the length of the spine 12 of the binder 10 with which the hanger and sheet lifter 22 is to be used.

Figure 3:
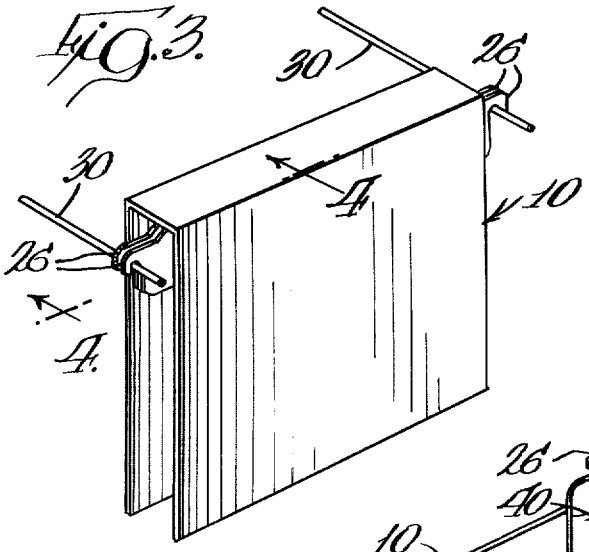
FIG. 3 is a perspective view of the ring binder disposed in a hanging position.

The hooks 26 include concave surfaces 28 which are spaced apart the distance corresponding to any desired spacing between a pair of parallel filing rails 30 (FIG. 3) so as to enable the binder 10 to be suspended thereon and in the fashion illustrated.

Each member defining a combination hanger and sheet lifter has a dimension transverse to its elongated dimension sufficient to enable it to function as a sheet lifter. Typically, this will be on the order of 2 inches or more.

Figure 4:
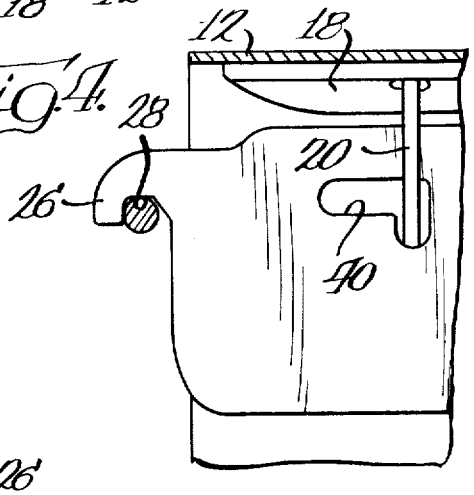
FIG. 4 is an enlarged, sectional view taken approximately along the lines 4—4 of FIG. 3.
Figure 5:
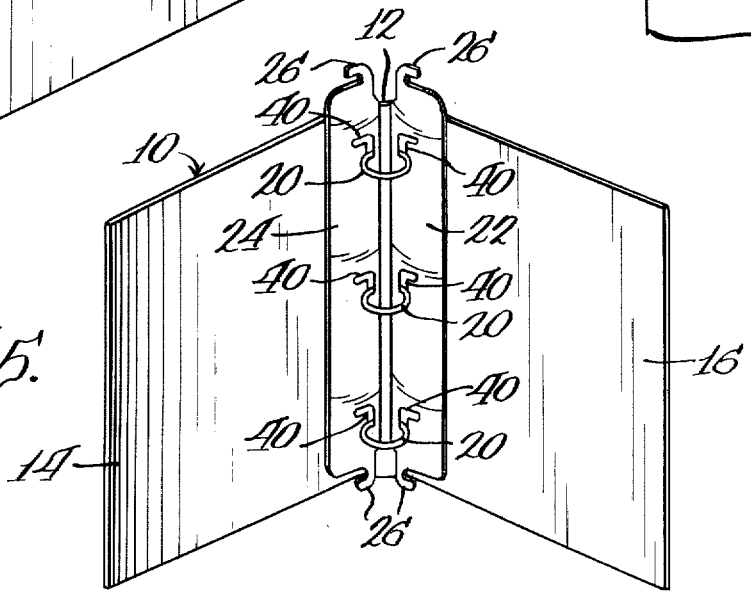
FIG. 5 is a perspective view of a partially open ring binder embodying a combination hanger and sheet lifter according to the invention with the ring binder being stood on end.

Moreover, each member is provided with a plurality of L-shaped slots 40 which are spaced along the length of the member the distance corresponding to the spacing between the rings 20 on the binder 10 with which it is to be used. As can be seen in FIG. 5, the L-shaped slots 40 are inverted with the upright of the L being elongated in the direction of elongation of the member and the inverted base of the L being directed away from the spine 12 of the binder member with which it is employed. The length of the upright of each L-shaped slot 40 is sufficient to enable the respective member 22 or 24 to be moved from a position wherein both hooks 26 are exposed (fragmentarily shown in FIG. 4 and fully shown in FIG. 1) to a position wherein one of the hooks, specifically the lower hook, on each member is wholly within the ring binder 10 as illustrated in FIG. 5. Preferably, the slots 40 are so located on the respective members that when each ring 20 is located at the point of intersection of the base and upright of the L defining the associated slot 40, as illustrated in FIG. 4, the member will be in the first mentioned position, that is, the position wherein both hooks 26 extend exteriorly and oppositely of the spine 12. Thus, when the binder is suspended on parallel rails such as the rails 30, the inverted base of each slot 40 receives a corresponding one of the rings 20, as illustrated in FIG. 4, to properly orient the binder on the combination hanger and sheet lifters 22 and 24.

When it is desired to stand the binder 10 on end, as is illustrated in FIG. 5, it is only necessary to shift the hangers and sheet lifters 22 and 24 on the rings 20 such that the rings are received in the end of the upright portion of the L-shaped slots 40 remote from the base thereof. In this position, the lowermost ones of the hooks 26 are fully within the binder so as to permit the same to be stood on end on an underlying surface without interference by the hooks 26.

A further feature of the invention is illustrated in FIG. 2 wherein it is seen that each of the combination hanger and sheet lifters 22 and 24 are slightly curved in a direction transverse to their length. This feature allows the same to function more efficiently as sheet lifters.

We claim:

1. A hanger and sheet lifter in combination with a ring binder having an elongated spine, a plurality of openable rings on the spine and covers attached to the spine, comprising:

an elongated sheet lifter having a length greater than the length of said spine and a width greater than the ring size and less than the cover width, a pair of hooks, one on each end of the lifter, opening in a direction away from the spine for receiving respective ones of spaced hanging rails for hanging support of the binder upon such rails;

means forming a plurality of elongated, uniform width closed end slots in the sheet lifter adjacent one edge thereof and extending in the direction of elongation of the lifter, each slot being located to receive one of said openable rings loosely threaded through the slot;

each slot having a length to allow the lifter to be shifted lengthwise of the binder spine in one direction to house one hook within the cover of the ring binder permitting standing the binder on end without interference between the housed hook and a supporting surface and to allow shifting of the lifter in opposite direction to expose both hooks outwardly of the binder for said hanging of the binder by the lifter upon rails, each lifter having means forming said slots with a closed leg extending in direction away from said adjacent one edge across the width of the lifter in alignment with the openable rings when both hooks are exposed outwardly of the binder permitting hanging of the binder by engagement of the spine on the lifters.

2. The combination of claim 1 wherein a pair of said sheet lifters are provided in the binder, one in the front and the other in the rear of the binder inside the covers.

3. The combination of claim 2 wherein said lifters are curved across their width to lift sheets of paper in the binder away from said covers.

* * * * *